US005460112A

United States Patent [19]

Travioli

[11] Patent Number: 5,460,112

[45] Date of Patent: Oct. 24, 1995

[54] SECURING APPARATUS

[76] Inventor: Lee C. Travioli, 1250 McKinley Ct., Dinuba, Calif. 93618

[21] Appl. No.: 142,043

[22] Filed: Oct. 18, 1993

Related U.S. Application Data

[63] Continuation of Ser. No. 871,133, Apr. 20, 1992, abandoned.

[51] Int. Cl.[6] ..... B63B 21/00

[52] U.S. Cl. ..... 114/230; 405/7

[58] Field of Search ..... 405/1–3, 7, 221, 405/219; 114/230

[56] References Cited

U.S. PATENT DOCUMENTS

| | | | |
|---|---|---|---|
| 2,658,354 | 11/1953 | Lee . | |
| 3,074,241 | 1/1963 | Cahill et al. | 405/221 |
| 3,146,599 | 9/1964 | Young | 405/1 |
| 3,221,899 | 12/1965 | Gronlund | 405/7 |
| 3,353,363 | 11/1967 | Edson . | |
| 3,492,825 | 2/1970 | Pearson | 405/219 |
| 3,579,996 | 5/1971 | Edson . | |
| 4,686,926 | 8/1987 | Vance . | |
| 4,732,105 | 3/1988 | Fisher . | |
| 4,899,681 | 2/1990 | Ottsman et al. . | |
| 5,067,428 | 11/1991 | Dickerson et al. | 405/1 |

*Primary Examiner*—Jesus D. Sotelo
*Attorney, Agent, or Firm*—Worrel & Worrel

[57] ABSTRACT

An apparatus for securing a movable work object relative to a substantially amorphous mass, the apparatus having a frame; a penetrating member adapted to be received in the amorphous mass; a member for interconnecting the penetrating member and the frame to retain the frame on the amorphous mass; and means for releasably securing the work object on the frame to secure the work object relative to the amorphous mass.

6 Claims, 2 Drawing Sheets

SECURING APPARATUS

This is a continuation of application Ser. No. 07/871,133, filed on Apr. 20, 1992, now abandoned.

BACKGROUND OF THE INVENTION

1. Field of the Invention

The present invention relates to a securing apparatus and, more particularly, to such a securing apparatus which is operable temporarily to secure a work object, such as a boat or the like, at substantially any location.

2. Description of the Prior Art

There are a variety of circumstances in which there is a need to secure a work object temporarily in a location where there is no convenient means available for accomplishing this task. For example, in boating for such purposes as water skiing, fishing, camping and the like there is frequently the need to secure the boat on a beach or bank adjacent to a body of water where no facilities are available to do so. Thus, in the case of water skiing on a lake or river, typically the boat is operated to a relatively remote location bounding the body of water and the participants disembark to set up a temporary camp. The water skiers then in turn operate out of this temporary camp while water skiing. Characteristically, there is no facility available for securing the boat at the time the camp is set up or at other times during the day when the boat is not in use or when passengers are boarding and/or leaving the boat.

At such times it is an expedient to drag a log or large rock to the position at which it is desired to secure the boat and thereafter to tie a securing line from the boat to the log or rock to achieve the desired result. Not only is this inconvenient and onerous, but frequently no such objects are readily available.

Other considerable disadvantages exist in this practice in that typically the boat is drawn partially up on the beach before being tied off leading to inordinate wearing of the underside of the hull. Furthermore, continual wave motion causes the hull to be worn against the sand of the beach and other more abrasive objects over time causing damage to the hull. In other instances, particularly where the beach slopes at a shallow angle beneath the surface of the water, the propeller and related equipment can be damaged in various ways by direct contact with the beach and other obstructions beneath the surface of the water.

Still further, because of the entirely make shift nature of such prior art practices, it is known where the boat is left unattended to have it pulled free from its securing point and drift away. This may lead only to the inconvenience of having to locate the boat, or in more aggravated situations to severe damage to the boat such as were it is carried down stream over rocks or into other such obstructions.

Therefore, it has long been known that it would be desirable to have a securing apparatus operable temporarily to secure a work object in a secure position even in the most remote location; which has particular utility in securing boats or the like on beaches or river banks where no readily available means exists for otherwise securing the boat; and which can conveniently be carried and operated with a minimum of effort operating to prevent all of the hazards incident to conventional prior art practices and capable of conveniently being stored in transport for use when needed.

SUMMARY OF THE INVENTION

Therefore, it is an object of the present invention to provide an improved securing apparatus.

Another object is to provide such a securing apparatus which can be employed temporarily to secure a work object such as a boat or the like on a beach, river bank or similar emplacement where no facility exist for this purpose.

Another object is to provide such a securing apparatus which avoids the necessity of using logs, boulders, or other cumbersome objects to secure boats or other vehicles on a land mass adjacent to a body of water where required for temporary purposes.

Another object is to provide such a securing apparatus which can readily be deployed for use, which applies the weight of the work object being secured in assisting with such securing and which prevents the work object from working itself free even after a long period of such restraint.

Another object is to provide such a securing apparatus which retains the work object, such as a boat, in supported position so as not to rest on abrasive sand or on rocks, logs or other obstructions which might otherwise damage the hull of the boat.

Another object is to provide such a securing apparatus which can be operated for readily releasing the boat into the body of water when desired and which can itself readily be released from the beach, riverbank or other enplacement when desired.

Another object is to provide such a securing apparatus which can be collapsed into a confined area for easy storage and which is otherwise of lightweight and convenient operation.

Further objects and advantages are to provide improved elements and arrangements thereof in an apparatus for the purpose described which is dependable, economical, durable and fully effective in accomplishing its intended purpose.

An apparatus for securing a movable work object relative to a substantially amorphous mass, the apparatus having a frame; a penetrating member adapted to be received in the amorphous mass; a member for interconnecting the penetrating member and the frame to retain the frame on the amorphous mass; and means for releasably securing the work object on the frame to secure the work object relative to the amorphous mass.

DESCRIPTION OF THE PREFERRED EMBODIMENT

Figure 1:
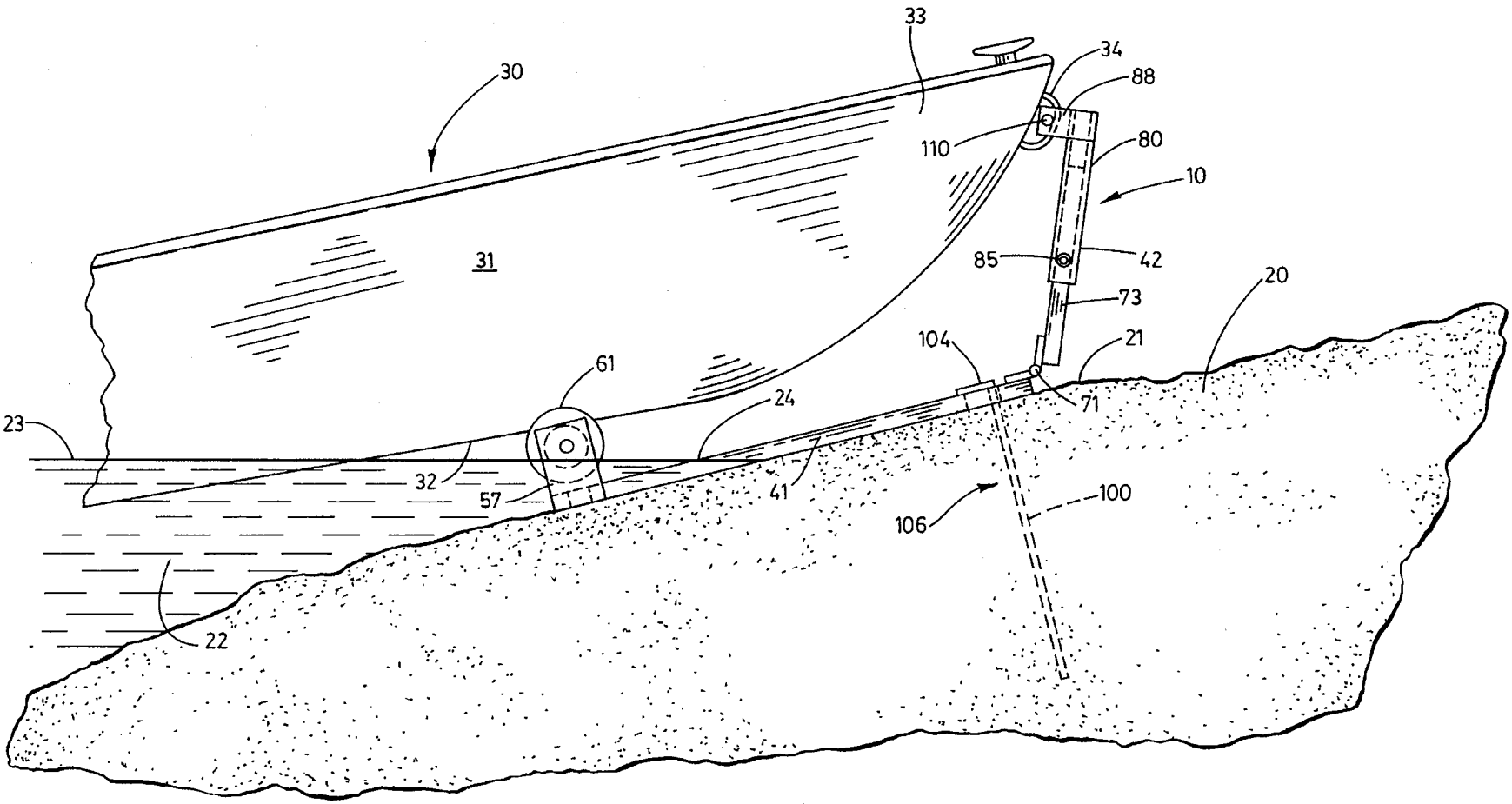
FIG. 1 is a fragmentary vertical section of a typical operative environment for the securing apparatus of the present invention depicting a beach and adjacent body of water on which the securing apparatus is mounted in an operational position securing a boat which is fragmentarily shown.

Referring more particularly to the drawings, the securing apparatus of the present invention is shown in FIG. 1 in a typical operative environment and is identified generally by the numeral 10 therein. As shown in FIG. 1, the securing apparatus is disposed in rested position on an amorphous mass which, for convenience, may be visualized as a beach 20 having an upper surface 21. The beach is adjacent to a body of water 22. The body of water which, also for convenience, may be visualized as a lake, has an upper surface 23 extending to and edge 24 of the body of water contacting the beach.

Also as shown in the illustrative environment of FIG. 1, a work object or boat is generally indicated at 30. It will be understood that the securing apparatus of the present invention can be employed in securing a wide variety of types of work objects of which boats, Jet Skis, other powered water craft and the like are merely representative. In the illustrative environment, the boat has a hull 31 which itself has a keel 32. The hull 31 has a bow 33 on which is mounted a hand grip 34 as is conventional in boat construction.

Figure 2:
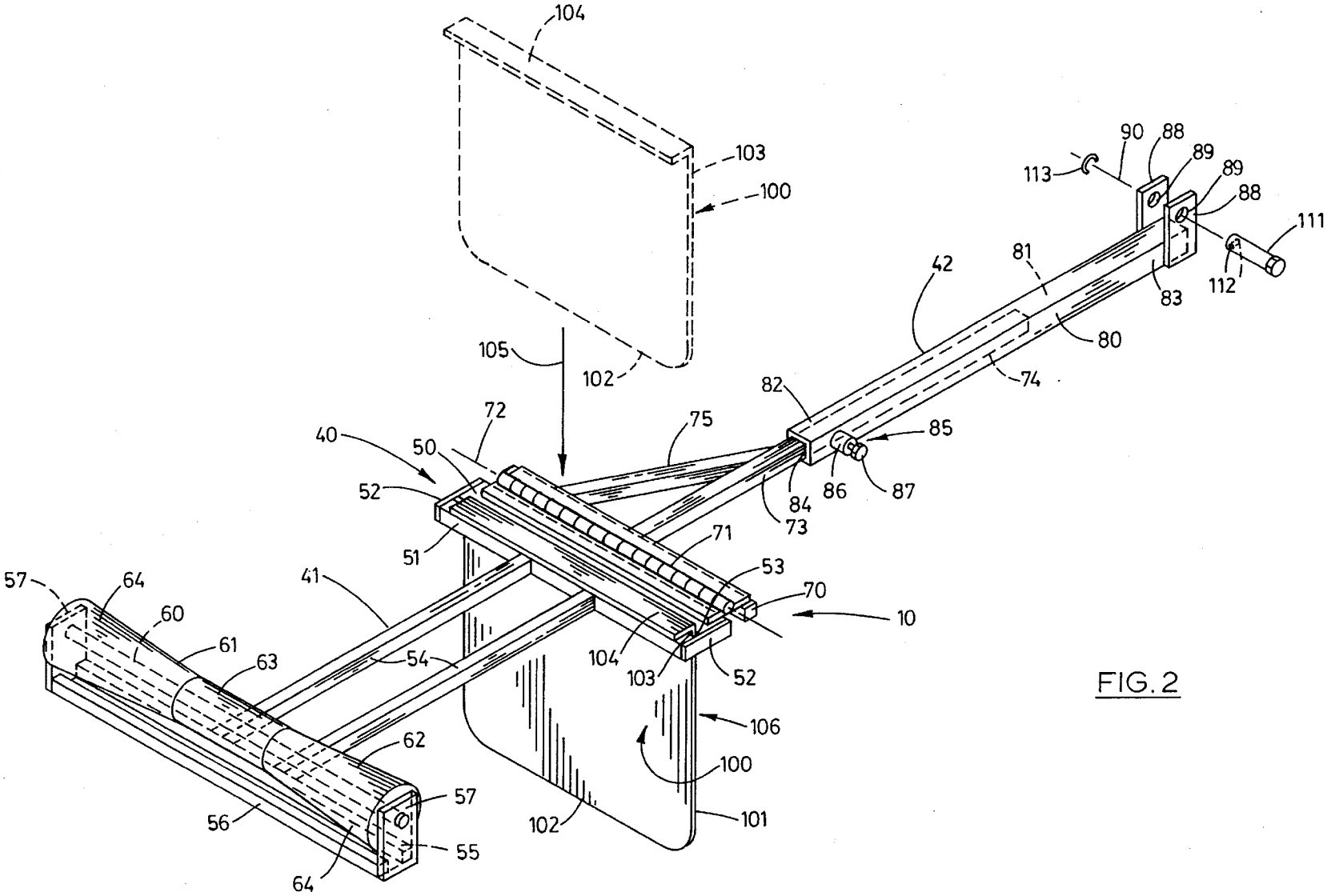
FIG. 2 is a somewhat enlarged perspective view of the securing apparatus of the present invention showing the securing blade or plate of the apparatus in full lines in an operational position and in phantom lines in a position withdrawn therefrom and with the second portion of the frame folded downwardly more conveniently to expose the operable portions thereof.

Turning then to the securing apparatus 10 of the present invention, its structure can, perhaps, best be visualized upon reference to FIG. 2. As shown therein, the securing apparatus has a frame 40 generally composed of a first portion 41 and a second portion 42.

The first portion 41 of the frame 40 has first and second transverse frame members 50 and 51, respectively, extending in closely spaced, substantially parallel relation to each other. The first and second transverse frame members are interconnected at their respective opposite ends by end plates 52 secured thereon by welding. Thus, the first and second transverse frame members and the end plates define a passage or slot 53 of narrow width. A pair of longitudinal frame members 54 are mounted on the second transverse frame member 51 in spaced, substantially parallel relation extending therefrom in substantially the same plane as the first and second transverse frame members 50 and 51. A first roller frame member 55 is mounted by welding on the distal ends of the longitudinal frame members extending in substantially right angular relation thereto. A second roller frame member 56 is disposed in spaced substantially parallel relation to the first roller frame member and the respective end portions of the frame members are interconnected by end plates 57 mounted thereon by welding. The end plates 57 extend upwardly from the roller frame members and mount a roller shaft 60 extending therebetween in spaced substantially parallel relation to the first and second roller frame members. A roller 61 is rotationally mounted on the roller shaft for rotational movement thereabout. The roller has an outer surface 62 composed of a central cylindrical surface 63 and a pair of convergent outer surfaces 64 coextensive therewith.

The second portion 42 of the frame 40 has a transverse frame member 70 pivotally interconnected with the first transverse frame member 50 of the first portion 41 of the frame by a hinge assembly 71. The hinge assembly mounts the first and second portions of the frame for pivotal movement relative to each other about a pivot axis 72. A longitudinal frame member 73 is mounted on the transverse frame member 70 by welding extending therefrom to a distal end portion 74 and disposed in substantially the same plane with the transverse frame member. A brace frame member 75 is mounted on and interconnects the end of the transverse frame member 70 and the longitudinal frame member so as to reinforce it.

The second portion 42 of the frame 40 includes a tubular frame member 80 having a longitudinal passage 81 and extending from a proximal end portion 82 to an opposite distal end portion 83. An entrance opening 84 is provided in the proximal end portion of the tubular frame member communicating with the longitudinal passage 81. The tubular frame member is telescopically received about the distal end portion 74 of the longitudinal frame member 73 for slidable movement therealong. Since the longitudinal frame member and tubular frame member are constructed of square section tubing and are relatively closely interfitted, they cannot rotate relative to each other. A fastener 85 is mounted on the proximal end portion 82 of the tubular frame member including an internally screw threaded sleeve 86 mounted on the proximal end portion of the tubular frame member in substantially right angular relation thereto communicating with the longitudinal passage 81. A lock bolt 87 is screw-threadably received therewithin operable to be screw-threadably adjusted to and from engagement with the longitudinal frame member therewithin selectively to lock the tubular frame member and longitudinal frame member in the desired longitudinal positions of telescopic adjustment.

The distal end portion 83 of the tubular frame member 80 mounts a pair of side plates 88, as by welding, on the opposite sides thereof extending in substantially right angular relation to the tubular frame member. The side plates each are pierced by holes 89 defining an axis 90 right angularly related to the tubular frame member.

A securing blade or plate 100 has a peripheral edge 101 and extends from a leading edge 102 to an upper portion 103. The plate is of relatively thin, but strong construction and is of a thickness such as to be slidably received in the slot 53 of the first portion 41 of the frame preferably with only limited play such as, for example, one-eighth inch (⅛") between the plate and the first transverse frame member 50 and between the plate and the second transverse frame member 51 when the plate is in position. The upper portion of the plate mounts a member or lip 104 extending at right angles thereto and preferably being of a width greater than the width of the slot 53. As can best be visualized in FIG. 2, the plate is slidable along a path 105 disposed at substantially right angles to the plane defined by the first portion 41 of the frame. The plate is movable between a retracted position shown in phantom lines in FIG. 2 and an operational position indicated at 106 therein.

The securing apparatus 10 further includes a fastener 110 consisting of a lock bolt 111 having holes 112 extending into the distal end portion of the bolt from opposite sides thereof. The fastener further includes a half moon clip 113 operable to be snap fitted over the distal end of the bolt with pins, not visible, individually received in the holes 112.

OPERATION

The operation of the described embodiment of the subject invention is believed to be clearly apparent and is briefly summarized at this point.

When not in use, the securing apparatus can be collapsed in such a manner as to permit it conveniently to be stowed in a small area securely and dependably without risk of losing any of the parts thereof. This can best be visualized by reference to FIG. 2. When the securing apparatus is to be stowed, the securing plate 100 is positioned with a lip 104 thereof received in the slot 53 and the plate disposed in rested engagement on the pair of longitudinal frame members 54 of the first portion 41 of the frame 40. The second portion 42 of the frame is pivoted relative to the first portion of the frame about the pivot axis 72 until the side plates 88 pass between the longitudinal frame members 54. The lock bolt 111 of the fastener 110 can then be passed through the holes and secured in position with the half moon clip 113, or more specifically the pins thereof not visible, individually received in the holes 112. The length of the lock bolt is such as to engage the undersides of the pair of longitudinal frame members 54 to secure the second portion in the collapsed position described with the securing plate 100 captured therebetween. If necessary to permit this position to be achieved, the lock bolt 87 can be loosened in the internally screw threaded sleeve 86 for telescopic repositioning of the tubular frame member 80 on the longitudinal frame member 73 of the second portion of the frame. The securing apparatus is thus collapsed to a compact and unitary configuration suitable for storing without risk of loss of any of the components thereof.

When it is desired to secure, for example, the boat 30 relative to the beach 20, the securing apparatus 10 is rendered available for such usage by a reversal of the steps heretofore described. Once the securing apparatus is open for use, the first portion 41 of the frame 40 is disposed in rested engagement with the upper surface 21 of the beach 20 oriented approximately so the longitudinal frame members 54 of the first portion 41 extend just into the water running approximately parallel to the fall line of the upper surface of the beach. The securing plate 100 is then disposed with its leading edge 102 received in the slot 53 and oriented so as to be able to follow the path 105 previously described. Using a hammer, rock or other available implement, the securing plate is driven downwardly through the slot and into the beach in approximately right angular relation to the upper surface 21 thereof until the securing plate is substantially fully received within the beach as shown in FIG. 1 and the lip 104 engages the upper surface of the second transverse frame member 51. This achieves securing of the first portion 41 of the frame 40 on the upper surface of the beach.

The boat 30 is subsequently operated or pulled so that its keel 32 passes onto and along the roller 61, preferably with the keel tiding on the central cylindrical surface 63 of the roller. The boat is moved forward until it reaches approximately the position shown in FIG. 1. At this point, the operator pivots the second portion 42 of the frame upwardly about the pivot axis 72 until the side plates 88 pass on opposite sides of the hand grip 34. The lock bolt is then slipped through the holes 89 of the side plates and through the hand grip and is secured in position using the half moon clip 113. The fastener 85 can be loosened to permit adjustment of the telescopic interrelationship of the longitudinal frame member 73 and tubular frame member 80 to achieve the desired relationship. Thereafter, the lock bolt 87 is again tightened in the internally screw threaded sleeve 86 until it abuts the longitudinal frame member 73 and thereby interlocks the longitudinal frame member and the tubular frame member.

The boat 30 is by this operation firmly secured in position. The securing plate 100 firmly secures one end of the first portion 41 of the frame 40 on the upper surface 21 of the beach 20. The weight of the boat rested on the roller 61 firmly secures the opposite end of the first portion 41 of the frame on the beach. As can be seen by reference to FIG. 1, the hull 31 of the boat is elevated completely from the upper surface 21 of the beach thereby avoiding abrasive contact with the sand of the beach and with obstructions beneath the upper surface 23 of the body of water 22 which might cause damage to the hull or other portions of the boat.

During repeated usage of the boat, the securing apparatus can, if desired, be left in position on the beach even when the boat is released therefrom for purposes of water skiing or the like. It can repeatedly be returned to the secured position for continued usage for this purpose.

When it is desired finally to leave the site, those persons travelling in the boat 30 can board over the bow or side of the boat while in the secured position, shown in FIG. 1. Once everyone, but one person has boarded, the securing apparatus is simply released by reversal of the steps heretofore described, folded into its collapsed configuration also heretofore described and stowed in the boat.

Therefore, the securing apparatus of the present invention operates to permit a wide variety of types of work objects to be temporarily secured in even the most remote locations where no readily available facility exists for securing the work object; operates to prevent damage to the work object during the period of time it remains secured in position; and can conveniently be collapsed and stored so as to be available for use when needed.

Although the invention has been herein shown and described in what is conceived to be the most practical and preferred embodiments, it is recognized that departures may be made therefrom within the scope of the invention which is not to be limited to the illustrative details disclosed.

Having described my invention, what I claim as new and desire to secure by Letters Patent is:

1. An apparatus for securing a water vehicle relative to a beach or bank bounding a body of water, the apparatus comprising a rigid frame having a first portion having a slot defining a path substantially transversely related to said first portion and a second portion mounted on the first portion for substantially pivotal movement about a pivot axis substantially parallel to said slot; a roller mounted on the first portion of the frame for rotational movement substantially about an axis of rotation substantially parallel to said slot; a plate dimensioned to be driven through the slot along said path into the beach or bank to penetrate the beach or bank and having a lip engageable with said first portion of the frame upon the plate reaching an operational position at a maximum extent of penetration of the beach or bank to capture the first portion of the frame between said lip and the beach or bank; and means borne by the second portion of the frame for securing to said water vehicle to retain said second portion in upstanding relation with the water vehicle rested on the roller while floating in said body of water whereby said water vehicle is secured relative to the beach or bank while being free for limited motion along the roller in response to motion in the body of water.

2. The apparatus of claim 1 wherein the width of the slot and the thickness of the plate are sufficiently close so as to permit substantially no play between them transversely of the slot in said operational position.

3. The apparatus of claim 2 wherein said roller is mounted at the opposite end of the first portion of said frame from the slot whereby the weight of the water vehicle rested on the roller holds down one end of said first portion and the lip of the plate holds down the opposite end of said first portion in said operational position.

4. The apparatus of claim 1 wherein said second portion of the frame has a telescopically extendable and retractable portion interconnecting said securing means and said pivot axis whereby the securing means is adjustable for securing relative to water vehicles of different sizes.

5. The apparatus of claim 4 including a fastener mounted on the second portion of the frame operable releasably to secure the said telescopically extendable and retractable portion in a selected position.

6. An apparatus for securing a water borne work object relative to a substantially amorphous mass bounding a body of water and which can be transported by said work object from site to site, the apparatus comprising a rigid frame less than one half the length of said work object, adapted to be rested on said amorphous mass and having a passage defining a path through the frame; a penetrating member adapted substantially slidably to be received in said passage of the frame and driven into said amorphous mass to retain the frame on the amorphous mass in said rested relation; an engagement assembly mounted on the frame in spaced relation to the passage thereof and deployed to receive a portion of said work object in rested relation thereon; and means for releasably securing the work object relative to the frame with said portion of the work object rested on said engagement assembly to secure the work object relative to the amorphous mass and wherein said securing means is moveable between an operating position, deployed for securing the work object thereto, and a storage position overlaying said frame, for storage of the apparatus.

* * * * *

UNITED STATES PATENT AND TRADEMARK OFFICE

CERTIFICATE OF CORRECTION

PATENT NO. : 5,460,112

DATED : October 24, 1995

INVENTOR(S) : Lee C. Travioli

It is certified that error appears in the above-identified patent and that said Letters Patent is hereby corrected as shown below:

Column 5, line 32, delete "tiding" and substitute

---riding---.

Signed and Sealed this

Ninth Day of January, 1996

*Attest:*

*Attesting Officer*

BRUCE LEHMAN

*Commissioner of Patents and Trademarks*